US011432644B2

(12) United States Patent
Davila et al.

(10) Patent No.: US 11,432,644 B2
(45) Date of Patent: Sep. 6, 2022

(54) FLOOR CLEANER AND TRAY

(71) Applicant: TECHTRONIC CORDLESS GP, Anderson, SC (US)

(72) Inventors: Rafael Davila, Kannapolis, NC (US); Nicholas DeBlasio, Waxhaw, NC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 17/279,676

(22) PCT Filed: Mar. 24, 2020

(86) PCT No.: PCT/US2020/024430

§ 371 (c)(1),
(2) Date: Mar. 25, 2021

(87) PCT Pub. No.: WO2020/198211

PCT Pub. Date: Oct. 1, 2020

(65) Prior Publication Data

US 2021/0337961 A1 Nov. 4, 2021

Related U.S. Application Data

(60) Provisional application No. 62/825,459, filed on Mar. 28, 2019.

(51) Int. Cl.
*A46B 17/06* (2006.01)
*A46B 13/00* (2006.01)
(Continued)

(52) U.S. Cl.
CPC ..... *A46B 17/06* (2013.01); *A46B 13/001* (2013.01); *A46B 13/02* (2013.01); *A47L 5/30* (2013.01);
(Continued)

(58) Field of Classification Search
CPC ..... A46B 17/06; A46B 13/001; A46B 13/02; A46B 2200/3033; A47L 5/30;
(Continued)

(56) References Cited

U.S. PATENT DOCUMENTS 8,001,653 B1 8/2011 Longley et al.
8,819,882 B2 9/2014 De Wit et al.
(Continued)

FOREIGN PATENT DOCUMENTS

CN 105534412 A 5/2016
CN 108024682 A 5/2018
(Continued)

OTHER PUBLICATIONS

Chinese Patent Office Action for Application No. 202080005532.8 dated Sep. 23, 2021 (8 pages including statement of relevance).
(Continued)

*Primary Examiner* — David Redding
(74) *Attorney, Agent, or Firm* — Michael Best & Friedrich LLP

(57) ABSTRACT

A combination of a floor cleaner and a cleaning tray. At least a portion of a base of the floor cleaner is received by a reservoir of the cleaning tray. The floor cleaner further including an upright portion movable between an inclined use position and an upright storage position. The brushroll is powered by a brushroll motor. The brushroll motor includes a control circuit that controls the brushroll. The control circuit has a first switch that is open when the floor cleaner is in the upright position and closed when the floor cleaner is in the inclined use position. The second switch is in parallel with the first switch. The second switch is opened in response to the portion of the base being removed from the cleaning tray and the second switch is closed when the portion of the base is in the cleaning tray.

22 Claims, 13 Drawing Sheets

(51) Int. Cl.

| | |
|---|---|
| ***A46B 13/02*** | (2006.01) |
| ***A47L 5/30*** | (2006.01) |
| ***A47L 9/04*** | (2006.01) |
| ***A47L 9/28*** | (2006.01) |
| ***A47L 7/00*** | (2006.01) |

(52) U.S. Cl.

CPC ..... *A47L 7/0023* (2013.01); *A47L 9/0411* (2013.01); *A47L 9/0477* (2013.01); *A47L 9/2821* (2013.01); *A47L 9/2842* (2013.01); *A47L 9/2847* (2013.01); *A47L 9/2863* (2013.01); *A46B 2200/3033* (2013.01)

(58) Field of Classification Search

CPC .... A47L 7/0023; A47L 9/0411; A47L 9/0477; A47L 9/2821; A47L 9/2842; A47L 9/2847; A47L 9/2863; A47L 9/0063; A47L 9/2873; A47L 11/201; A47L 11/292; A47L 11/302; A47L 11/4041; A47L 5/28

See application file for complete search history.

(56) References Cited

U.S. PATENT DOCUMENTS

| | | | |
|---|---|---|---|
| 2018/0344112 | A1 | 12/2018 | Krebs et al. |
| 2020/0069137 | A1 | 3/2020 | Nguyen |

FOREIGN PATENT DOCUMENTS

| | | | |
|---|---|---|---|
| CN | 108720753 | A | 11/2018 |
| CN | 108968835 | A | 12/2018 |
| DE | 102008018511 | A1 | 10/2009 |
| EP | 3409167 | A1 | 12/2018 |
| WO | 2008074014 | A2 | 6/2008 |
| WO | 2019246492 | A1 | 12/2019 |

OTHER PUBLICATIONS

International Search Report and Written Opinion for Application No. PCT/US2020/024430 dated Jun. 23, 2020 (15 pages).

U.S. Appl. No. 62/789,661, filed Jan. 8, 2019, by Bissell Inc. (67 pages including cover page).

U.S. Appl. No. 62/688,439, filed Jun. 22, 2018, by Bissell Homecare, Inc. (67 pages including cover page).

FLOOR CLEANER AND TRAY

CROSS-REFERENCE TO RELATED APPLICATIONS

This application claims priority to U.S. Provisional Patent Application No. 62/825,459, filed Mar. 28, 2019, the entire contents of which are hereby incorporated by reference herein.

BACKGROUND

The present invention relates to a floor cleaner, and more particularly to a floor cleaner with a cleaning tray.

SUMMARY

In one embodiment, a combination of a floor cleaner and a cleaning tray is disclosed. The cleaning tray forms a reservoir. The floor cleaner includes a base movable along a surface to be cleaned. At least a portion of the base received by the reservoir of the cleaning tray. The floor cleaner further including an upright portion movable between an inclined use position and an upright storage position, a suction motor, a fluid distributer in fluid communication with a supply tank, and a brushroll rotatably arranged in the base. The brushroll is powered by a brushroll motor. The brushroll motor includes a control circuit that controls the brushroll. The control circuit has a first switch that is open when the floor cleaner is in the upright position and closed when the floor cleaner is in the inclined use position. The second switch is in parallel with the first switch. The second switch is opened when the portion of the base is removed from the cleaning tray and the second switch is closed when the portion of the base is in the cleaning tray.

Also disclosed is a method of cleaning a floor cleaner having a supply tank, a recovery tank, and a fluid distributor using a cleaning tray. The method includes sensing the floor cleaner in the cleaning tray by a control circuit in the floor cleaner being activated by an actuator in the cleaning tray. A cleaning mode is then activated and cleaning fluid is distributed from the supply tank into the cleaning tray via the fluid distributor.

In another embodiment, a combination of a floor cleaner and a cleaning tray includes a floor cleaner having a base movable along a surface to be cleaned, an upright portion movable between an inclined use position and an upright storage position, a brushroll rotatably arranged in the base. The brushroll is powered by a brushroll motor. The brushroll motor includes a control circuit that controls the brushroll. The control circuit is operable in a brushroll-enabled condition when the floor cleaner is in the inclined use position; a brushroll-disabled condition when the floor cleaner is in the upright position and the floor cleaner is not in the cleaning tray; and a brushroll-enabled condition when the floor cleaner is in the cleaning tray. The cleaning tray includes an actuator. The actuator activates the control circuit into the third condition, and the control circuit enables a cleaning mode in the third condition.

In another embodiment, a combination of a floor cleaner and a cleaning tray includes a floor cleaner having a base movable along a surface to be cleaned, an upright portion movable between an inclined use position and an upright storage position, a suction motor, a fluid distributer in fluid communication with a supply tank, and a brushroll rotatably arranged in the base. The brushroll is powered by a brushroll motor. The brushroll is operable when the floor cleaner is in the upright position in the cleaning tray. The cleaning tray forms a reservoir configured to receive at least a portion of the base of the floor cleaner.

In yet another embodiment, a combination of a floor cleaner and a cleaning tray includes a floor cleaner having a base movable along a surface to be cleaned, an upright portion movable between an inclined use position and an upright storage position, a suction motor, a fluid distributer in fluid communication with a supply tank, and a brushroll rotatably arranged in the base. The brushroll is powered by a brushroll motor. The brushroll is operable when the floor cleaner is in the inclined use position in the cleaning tray. The cleaning tray forms a reservoir configured to receive at least a portion of the base of the floor cleaner. The cleaning tray further includes a support structure configured to support the upright portion of the floor cleaner in the inclined use position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
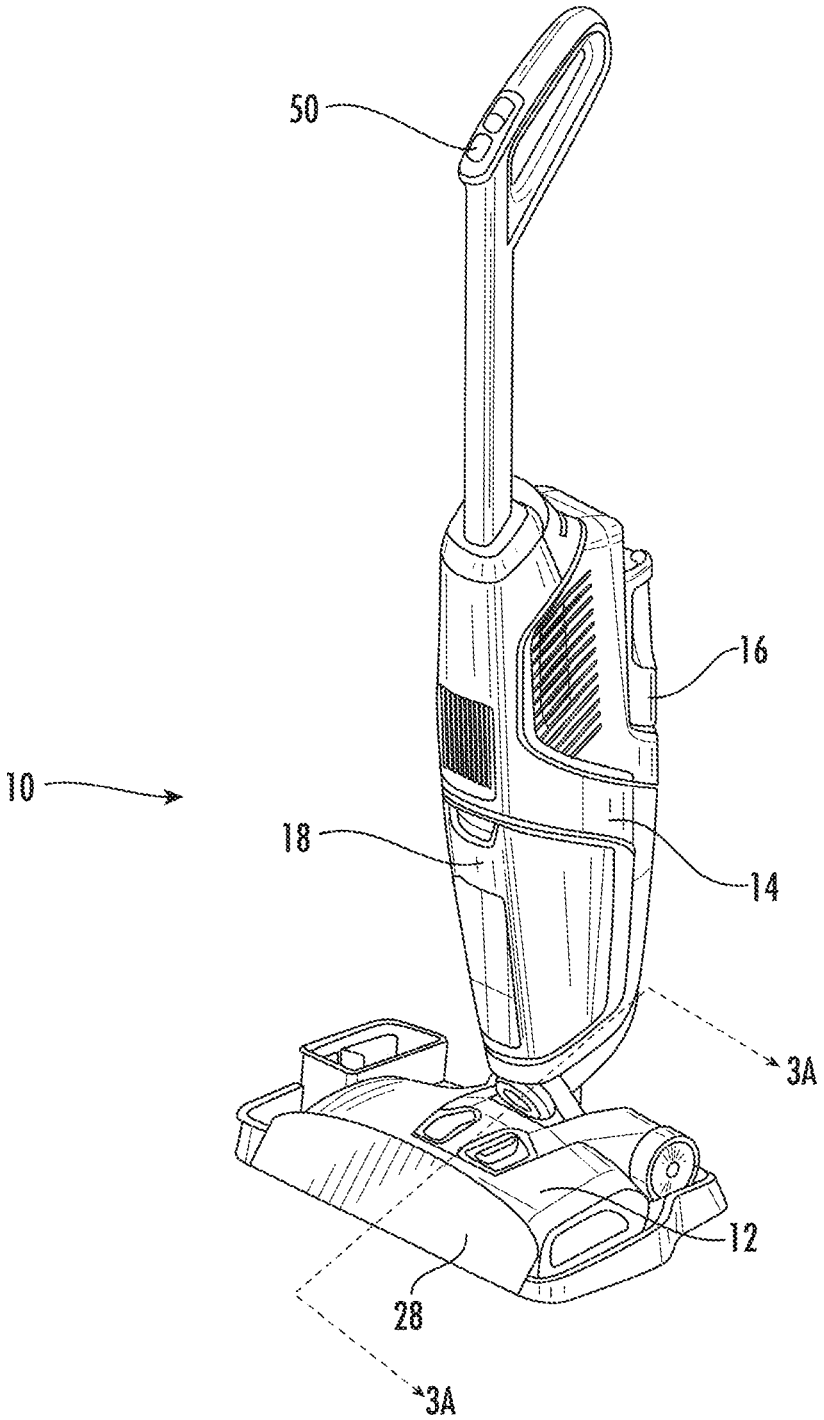
FIG. 1 is a perspective view of a floor cleaner positioned in an upright storage position in a cleaning tray.
Figure 1A:
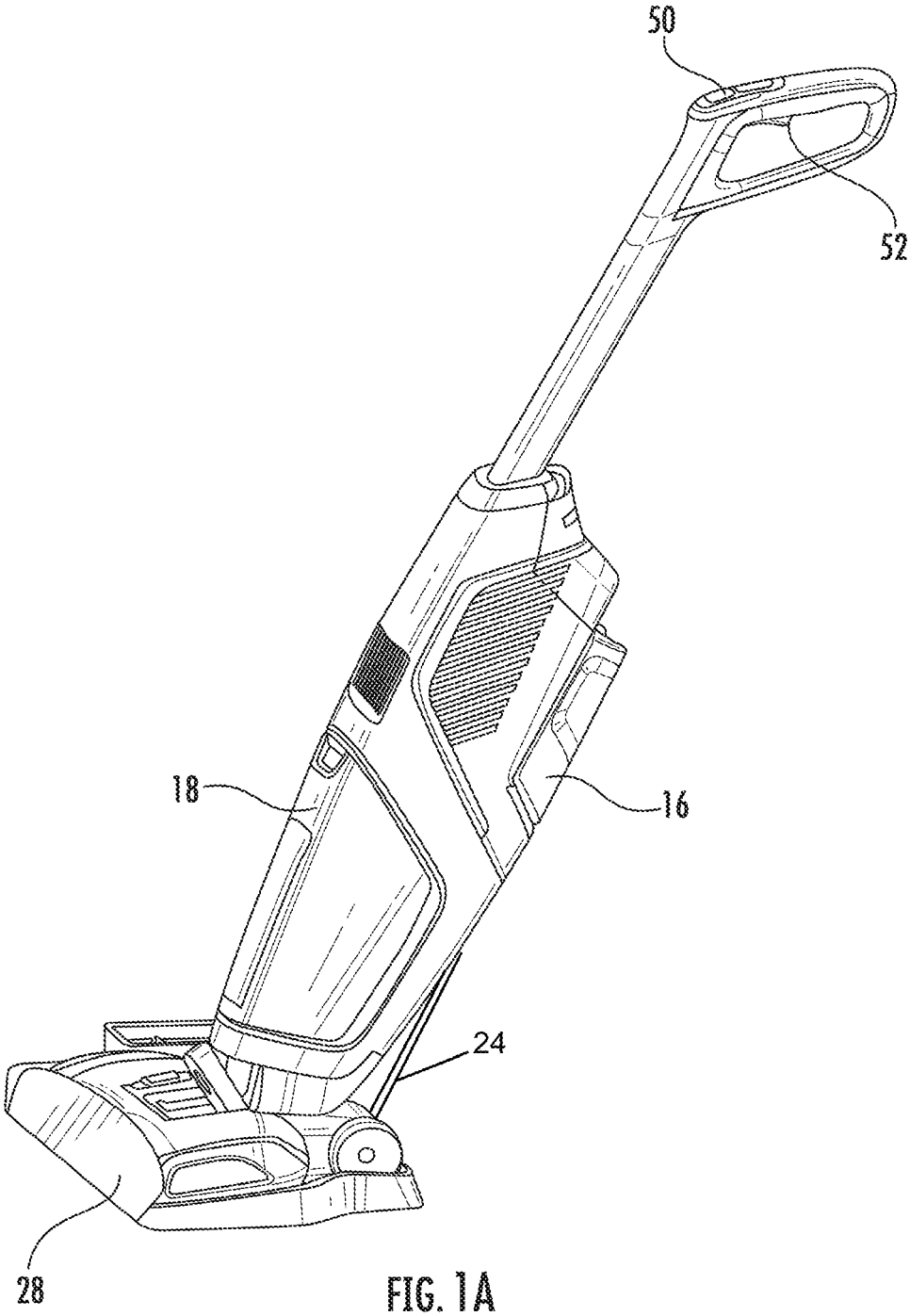
FIG. 1*a* is a perspective view of the floor cleaner positioned in an inclined use position in the cleaning tray.
Figure 2:
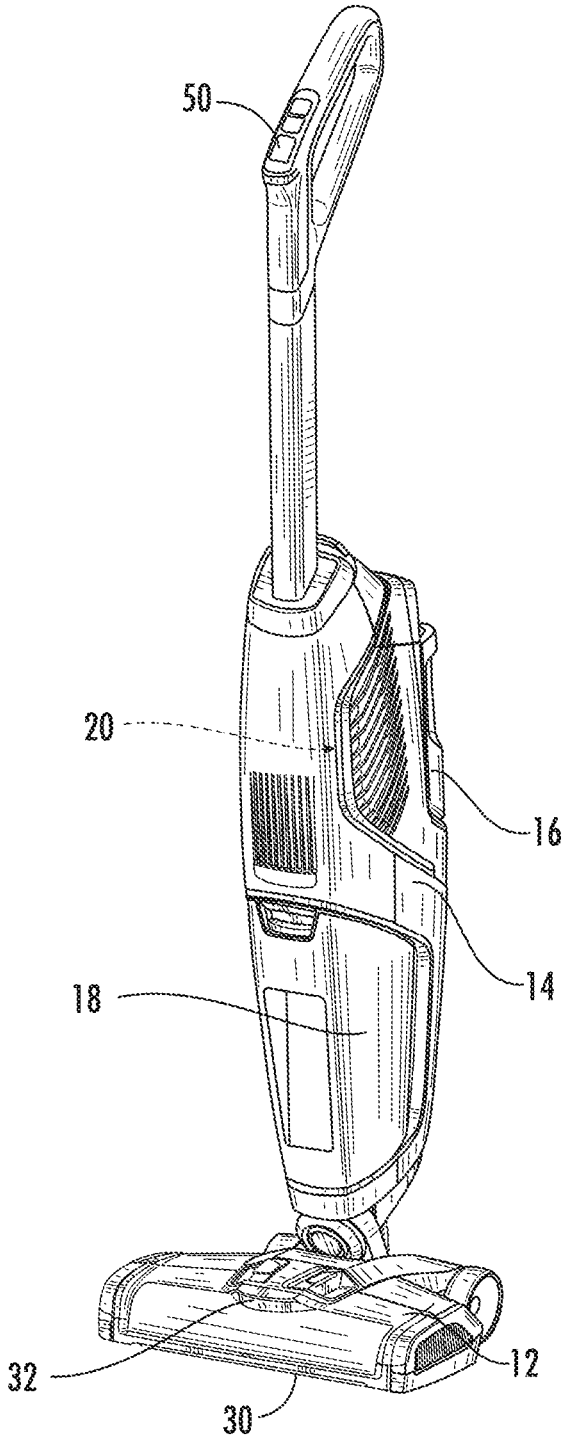
FIG. 2 is a perspective view of the floor cleaner without the cleaning tray.

FIG. 1 illustrates a floor cleaner 10 positioned in a cleaning tray 28. The cleaning tray 28 enables the floor cleaner 10 to operate in a cleaning mode in the cleaning tray 28 to clean a brushroll 26 and other portions of the floor cleaner 10. In the illustrated embodiment, the floor cleaner 10 includes a base 12 and an upright portion 14 pivotally coupled to the base 12. The upright portion 14 is pivotal relative the base 12 between an upright storage position (FIG. 1) in which the upright portion 14 is maintained in an upright position by the base 12 and an inclined use position (FIG. 1*a*). The floor cleaner 10 further includes a supply tank 16, a recovery tank 18, and a suction motor 20. The supply tank 16 is configured to store a cleaning fluid and the floor cleaner 10 is operable to dispense the cleaning fluid onto a surface to be cleaned through a fluid distributor 56 including a pump 34 or valve 38 and a distribution nozzle 32 or an auxiliary fluid outlet 36, respectively. The base 12 further includes a suction inlet 30 in fluid communication with the suction motor 20 and the recovery tank 18. The cleaning fluid is drawn from the surface to be cleaned through the suction inlet 30 and into the recovery tank 18.

Figure 5:
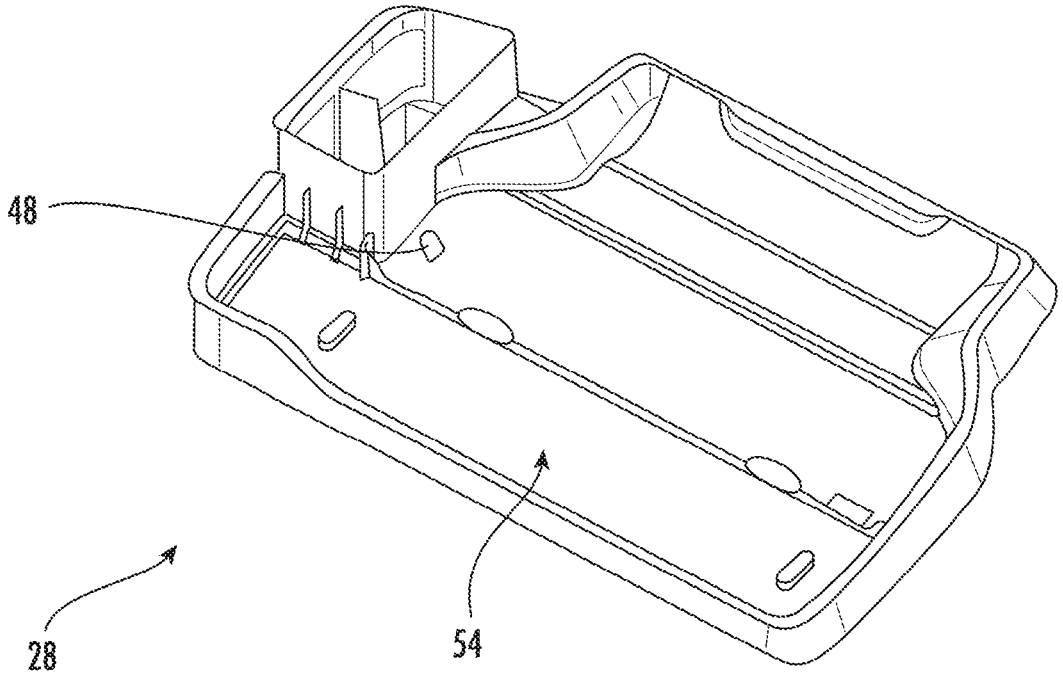
FIG. 5 is a perspective view of the cleaning tray.

The cleaning tray 28 is configured for the base 12 to be placed in the cleaning tray 28 for cleaning and/or storage of the floor cleaner 10. The cleaning tray 28 forms a reservoir 54 (FIG. 5) configured to receive cleaning fluid as well as receive at least a portion of the base 12 of the floor cleaner 10 when the base 12 is placed in the cleaning tray 28.

The floor cleaner 10 includes at least one brushroll 26 being rotatably arranged in the base 12. The brushroll 26 is driven by a brushroll motor 46, and the floor cleaner 10 includes a control circuit 40 connected to and operable to control the brushroll motor 46. The control circuit 40 is operable in a brushroll-enabled condition when the floor cleaner 10 is in the inclined use position; a brushroll-disabled condition when the floor cleaner is in the upright position and the floor cleaner is not in the cleaning tray; and a brushroll-enabled condition when the floor cleaner is in the cleaning tray. Thus, when the floor cleaner 10 is in the upright storage position, the brushroll 26 will not be activated unless the floor cleaner 10 is in the cleaning tray 28.

Figure 6:
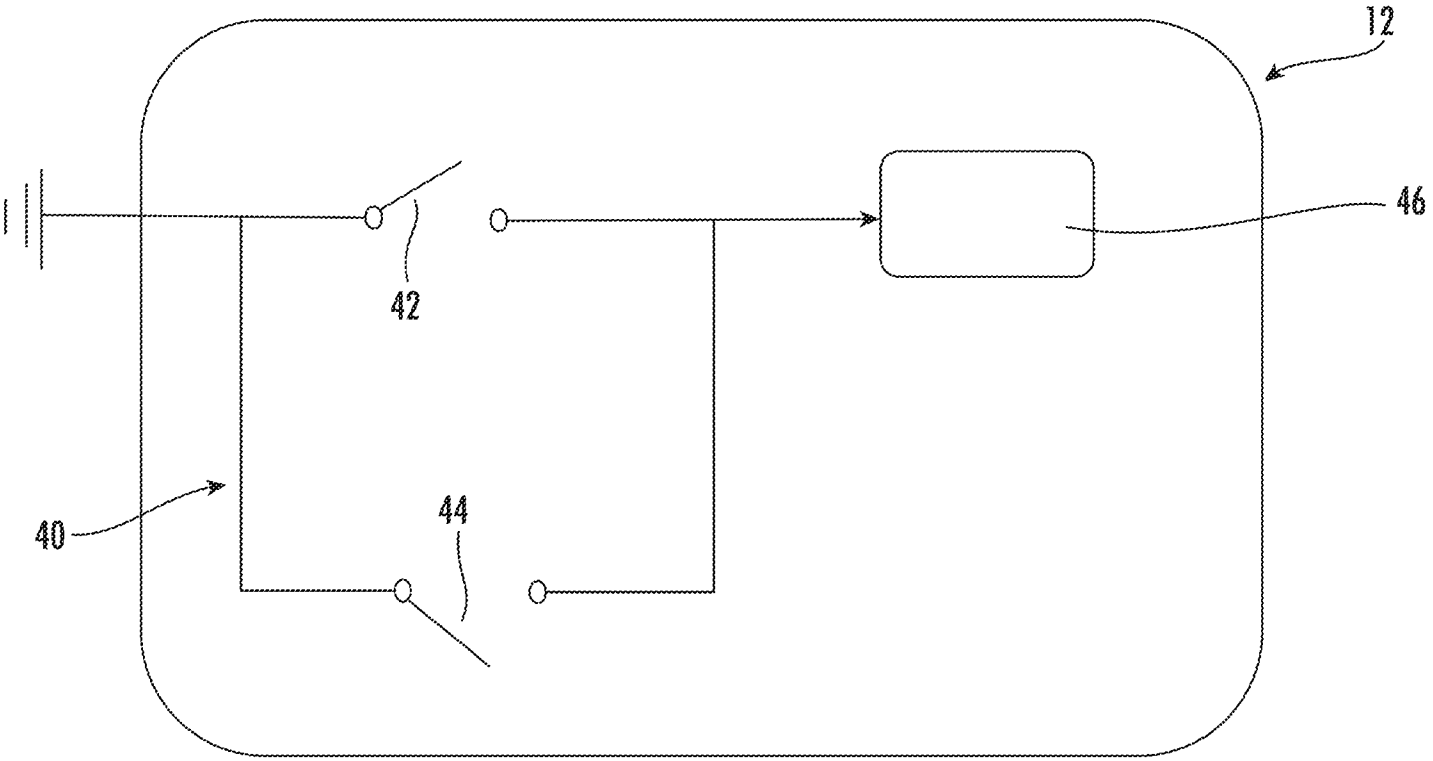
FIG. 6 is a schematic diagram of a brushroll motor control circuit representing the floor cleaner being in an upright storage position, without the cleaning tray.
Figure 7:
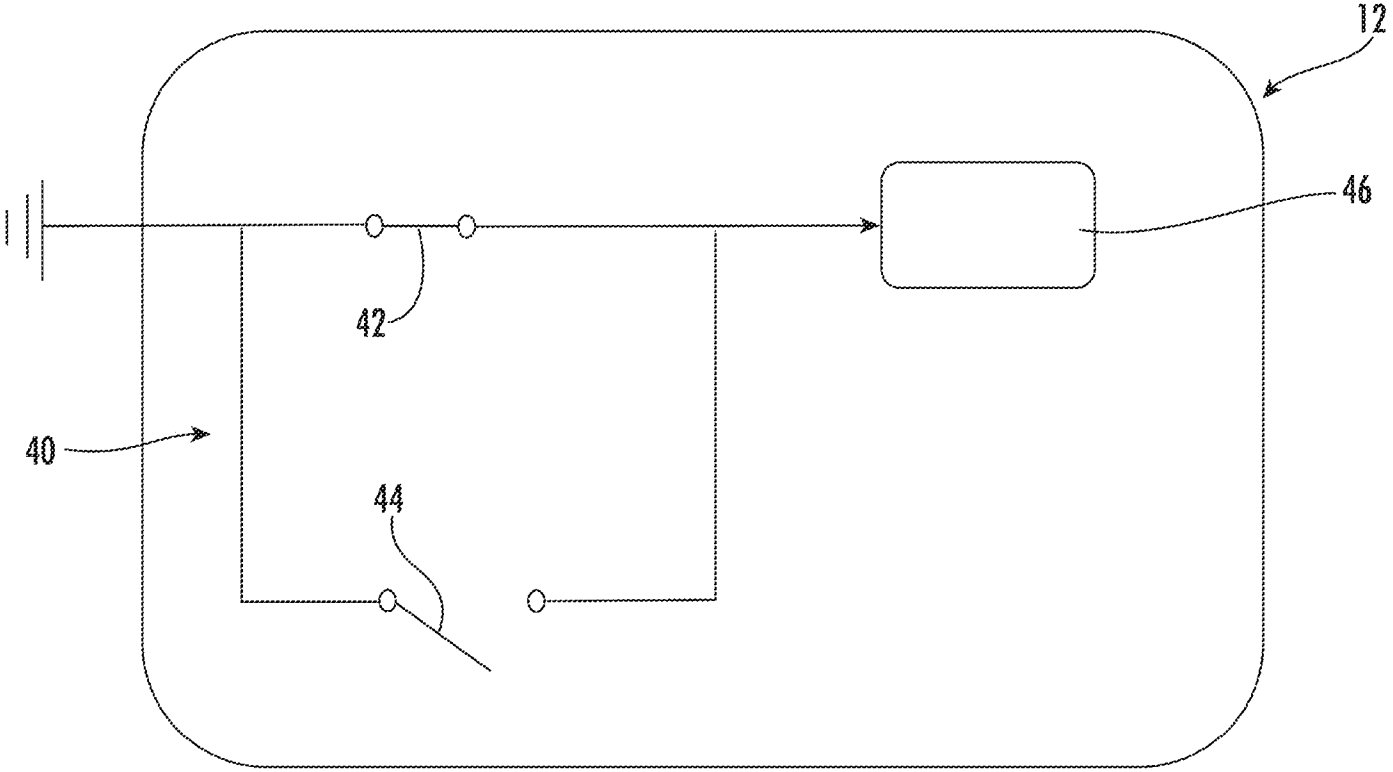
FIG. 7 is a schematic diagram of the brushroll motor control circuit representing the floor cleaner being in an inclined use position, without the cleaning tray.
Figure 8:
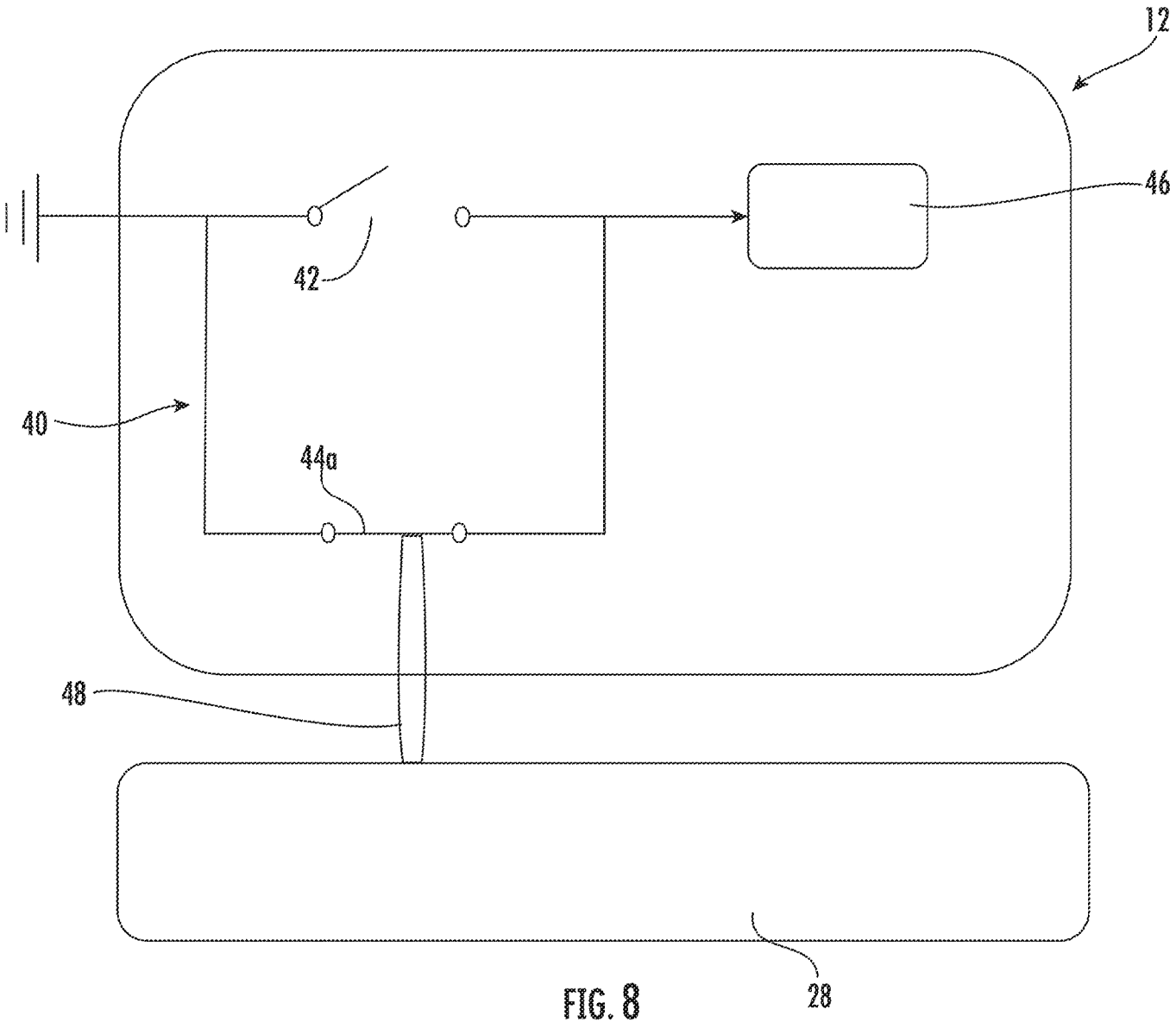
FIG. 8 is a schematic diagram of the brushroll motor control circuit representing the floor cleaner being in an upright storage position in the cleaning tray, where the cleaning tray has a mechanical actuator.
Figure 9:
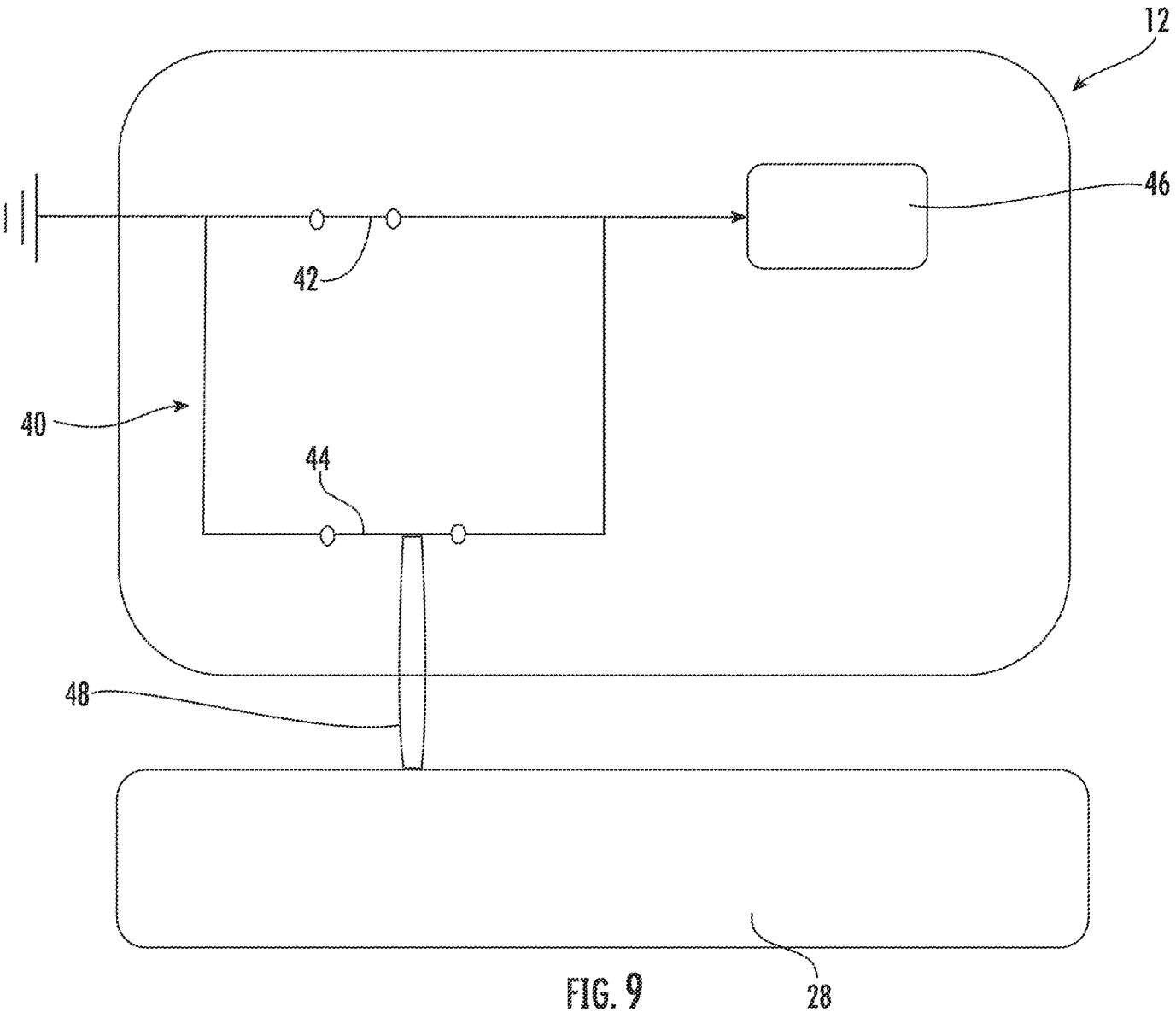
FIG. 9 is a schematic diagram of the brushroll motor control circuit representing the floor cleaner being in an inclined use position in the cleaning tray.

In one embodiment, the control circuit 40 includes two switches 42, 44 connected in parallel. The first switch 42 is open when the floor cleaner 10 is in the upright storage position (FIG. 6). The first switch 42 is closed when the floor cleaner 10 is in the inclined use position (FIG. 7). The second switch 44 is open when the floor cleaner 10 is not in the cleaning tray 28 (FIGS. 6 and 7). When the floor cleaner 10 is placed in the cleaning tray 28, the second switch 44 is closed by the cleaning tray 28 (FIGS. 8 and 9). As used in this specification and appended claims, a switch being "open" is not necessarily a physical discontinuity in a circuit, but more generally means disabling a function or operation by an electrical disconnection, electrical connection, software instruction, firmware operation, or other control. As used in this specification and appended claims, a switch being "closed" is not necessarily a physical continuity in a circuit, but more generally means enabling a function or operation by an electrical connection, electrical disconnection, software instruction, firmware operation, or other control.

As schematically illustrated in FIGS. 8 and 9, the second switch 44 is positioned in the floor cleaner 10, for example, in the base 12, so that it can be closed by an actuator 48 in the cleaning tray 28. In one embodiment, the second switch 44 is a mechanically actuated contact switch and the actuator is a mechanical actuator 48 positioned in the cleaning tray 28 (shown in FIGS. 6 and 8). The mechanical actuator in the cleaning tray 28 may be a rib, a pin, a protrusion, or other shape or feature positioned to actuate the second switch in the floor cleaner when the base 12 is placed in the cleaning tray 28. In the example shown in FIG. 5, the mechanical actuator 48 is a protrusion extending upwardly positioned to engage the second switch in the base 12. The second switch 44 may be adjacent an outer surface of the base positioned for direct engagement with the mechanical actuator 48. In one embodiment, the mechanical actuator 48 enters a recess or aperture in the base 12 to actuate the second switch 44. In one embodiment, the actuator 48 contacts a linkage or other intermediate member that actuates the second switch in the floor cleaner when the base 12 is placed in the cleaning tray 28.

Figure 6A:
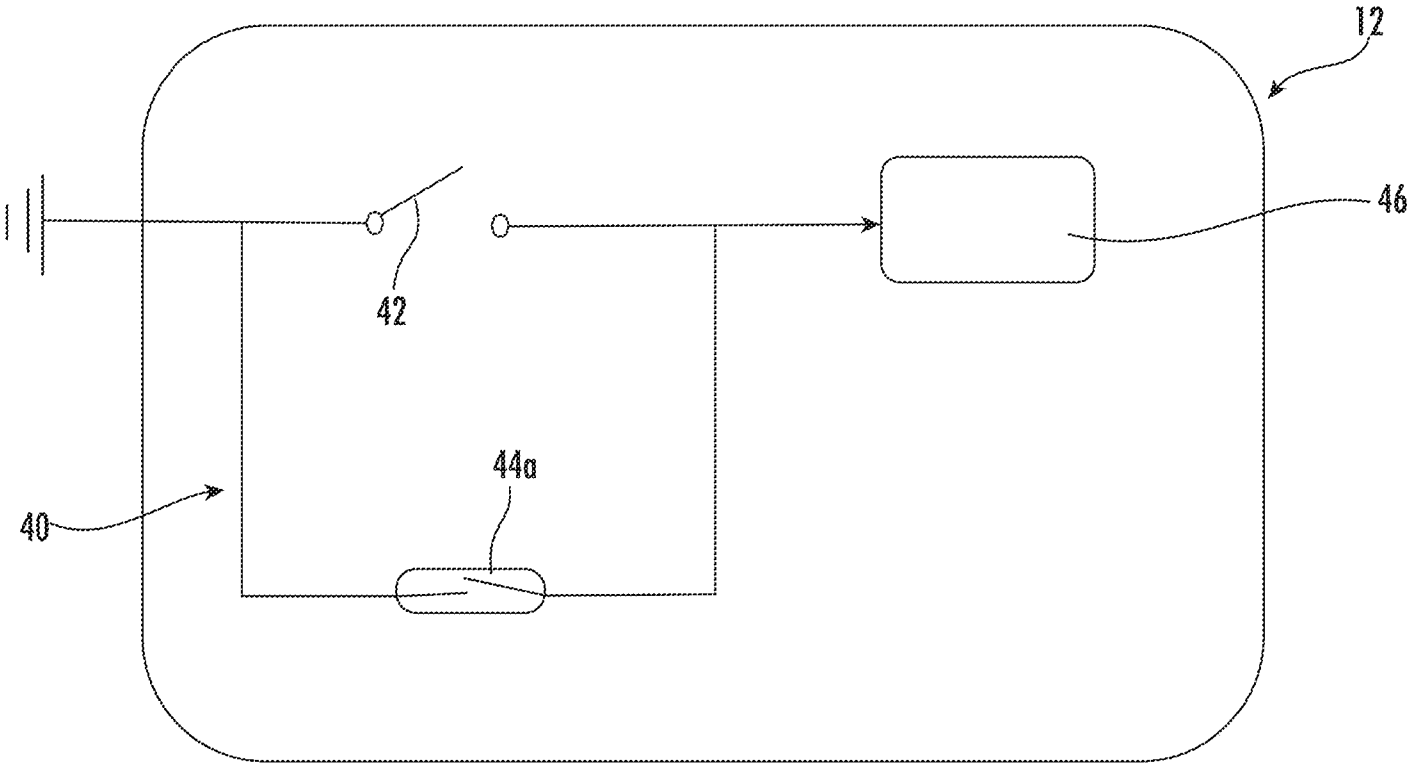
FIG. 6*a* is a variation of the control circuit of FIG. 6 with a reed switch.
Figure 8A:
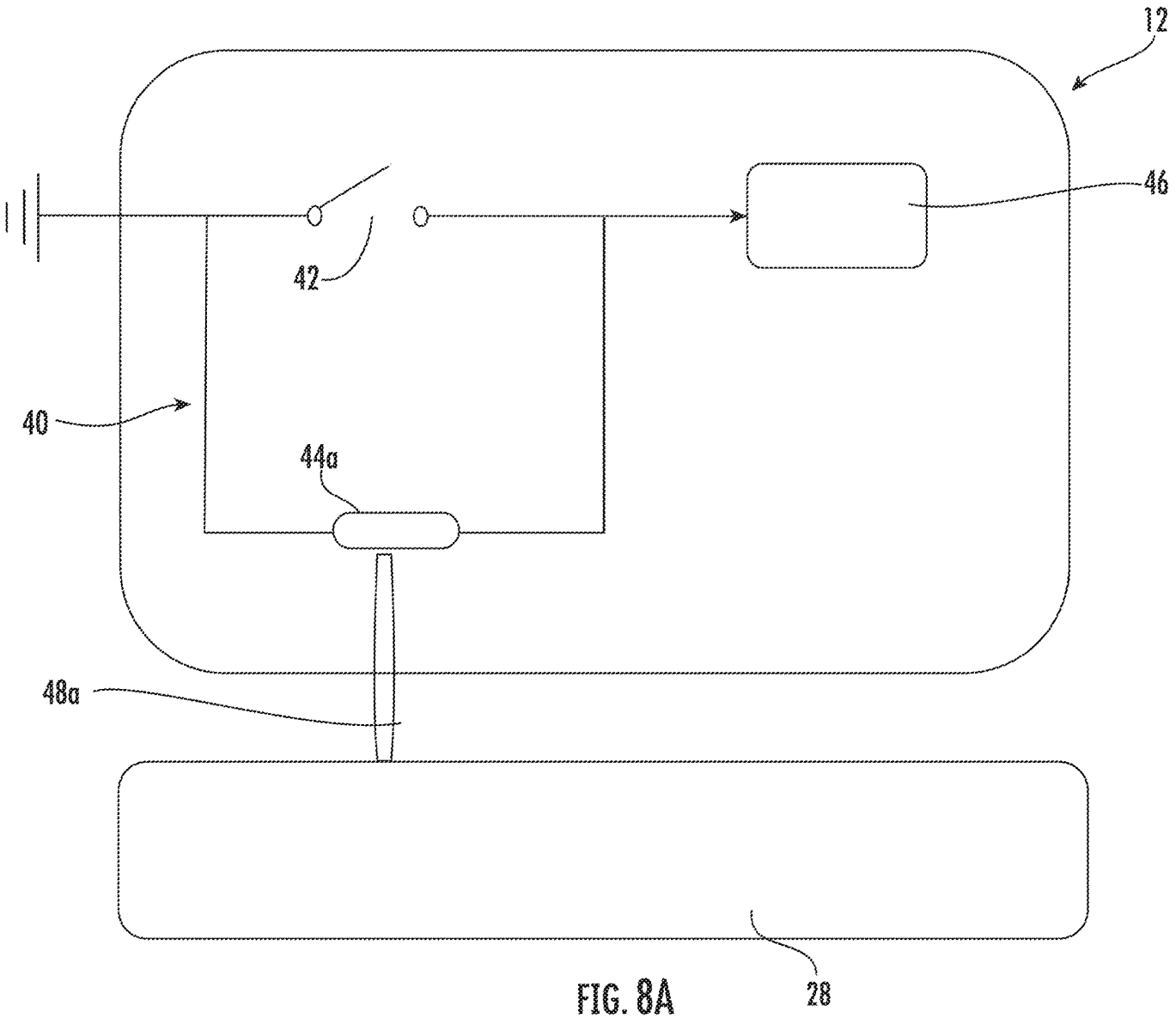
FIG. 8*a* is a variation of the control circuit of FIG. 8, where the cleaning tray has a magnet.

In one embodiment, the second switch 44 is a magnetically activated switch, for example a reed switch 44*a* and the actuator is a magnet 48*a* (shown in FIGS. 6*a* and 8*a*). In this embodiment, the reed switch 44*a* is positioned in the floor cleaner in a location corresponding to the location of the magnet 48*a* in the cleaning tray when the base 12 is placed in the cleaning tray 28. In another embodiment, the second switch 44 is a Hall Effect sensor and the actuator is a magnet positioned in the tray.

In one embodiment, the second switch is a light activated switch, and the actuator on the cleaning tray is a light, a shape, a bar code, a reflector, or other feature sensed by the light activated switch when the base 12 is placed in the cleaning tray 28. In other embodiments, the second switch 44 may be another type of proximity sensor configured to cooperate with the cleaning tray to actuate the control circuit, such as a pressure sensor, ultrasonic sensor, or other proximity sensor.

The floor cleaner 10 may include a controller configured to control operation of one or more components of the floor cleaner. In one embodiment, the second switch 44 is configured to provide a signal to the controller when the control circuit 40 senses the cleaning tray 28 by the actuator 48 actuating the second switch 44. In one embodiment, the control circuit 40 is operatively connected to the controller in the floor cleaner 10. In another embodiment, the control circuit 40 includes the controller. The controller may be operatively connected to the fluid distributor 56, and configured to distribute solution from the supply tank 16 in response to activation of the second switch 44 by the cleaning tray 28. The controller may further be operatively connected to the suction motor 20, and configured to activate the suction motor 20 in response to activation of the second switch 44 by the cleaning tray 28.

Figure 3:
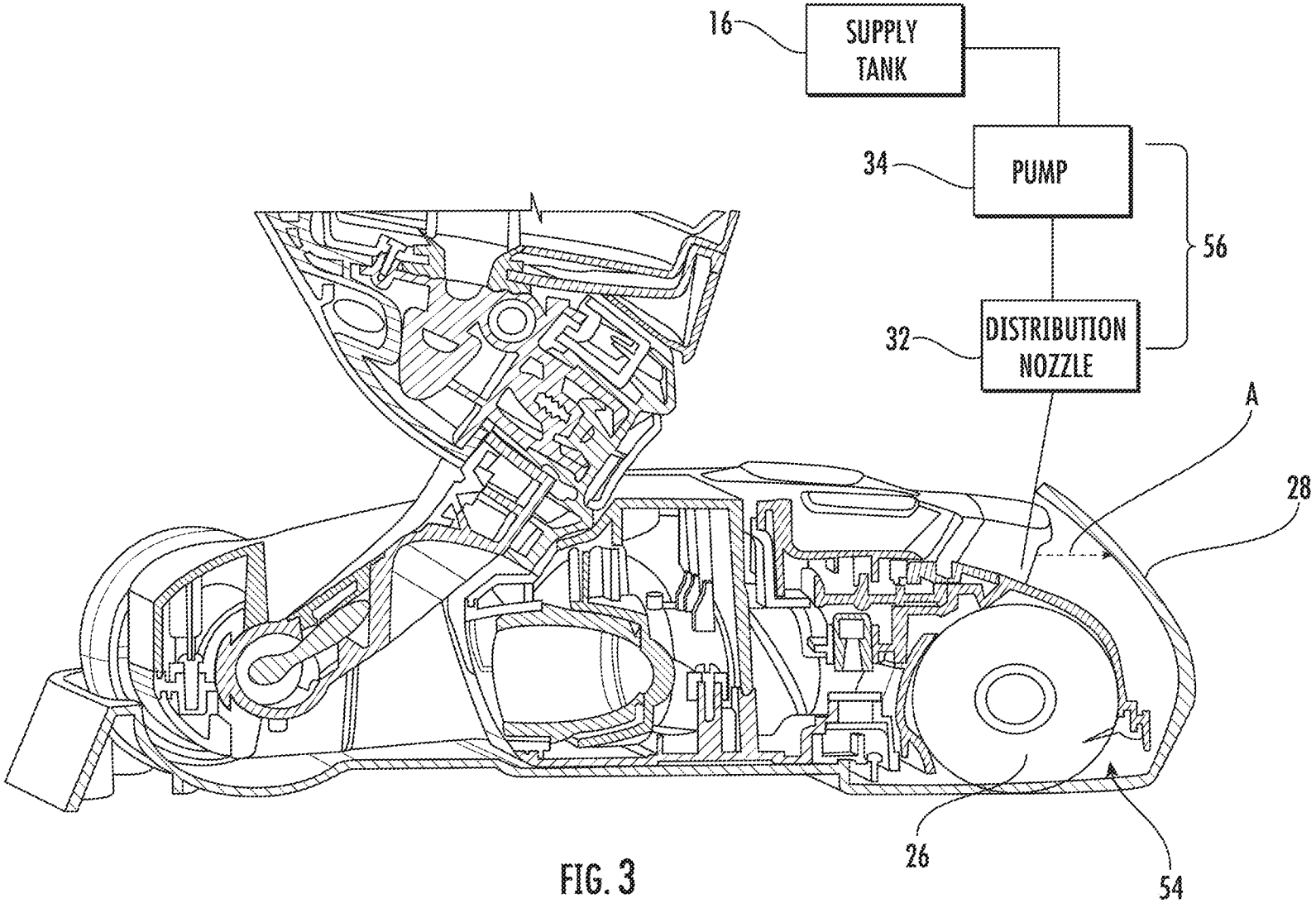
FIG. 3 is a cross-section of a base of the floor cleaner in the cleaning tray with a schematic illustration of a fluid distributor.
Figure 3A:
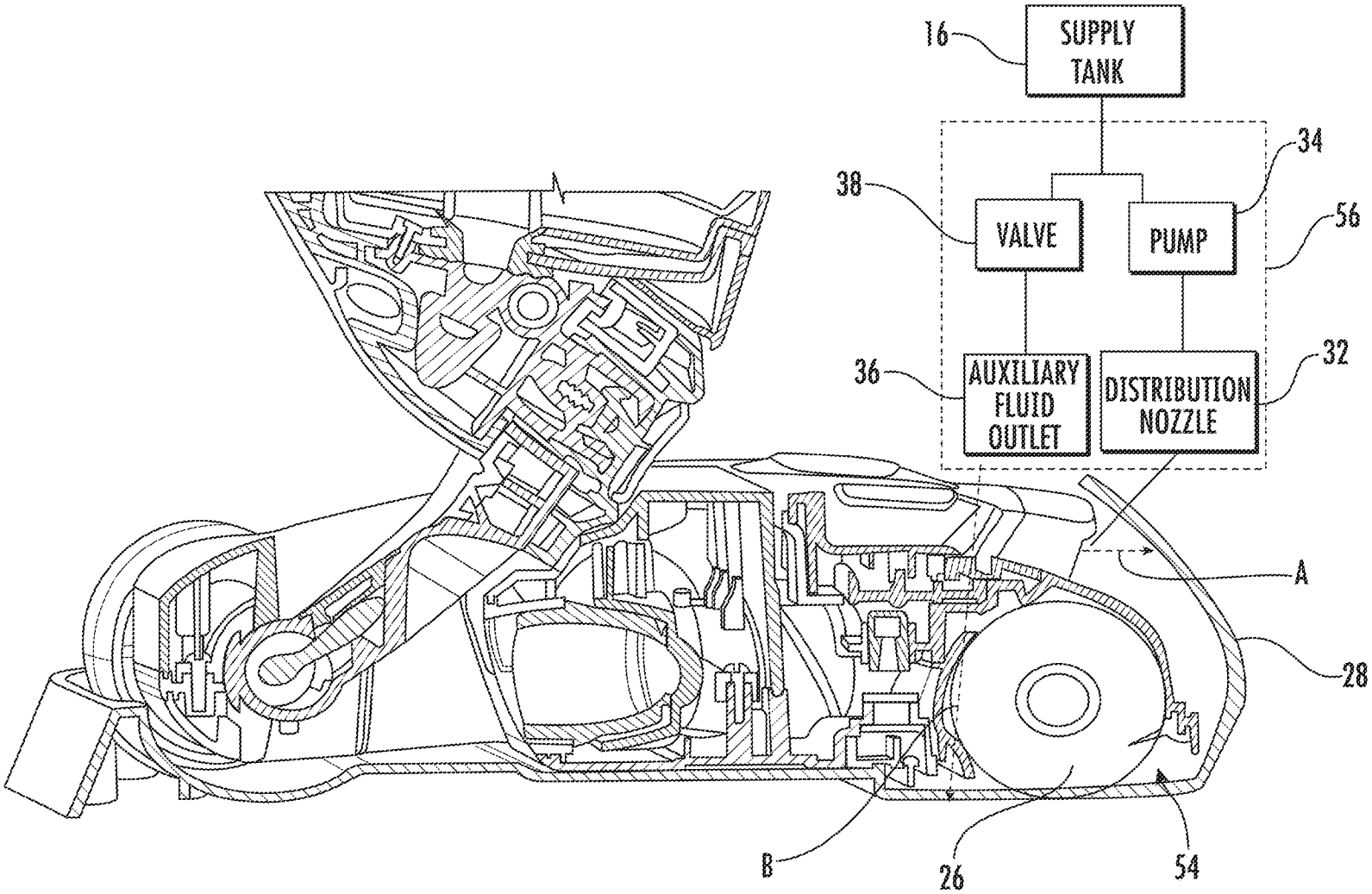
FIG. 3*a* is a cross-section of the base of the floor cleaner in the cleaning tray with a schematic illustration of an alternate fluid distributor.
Figure 4:
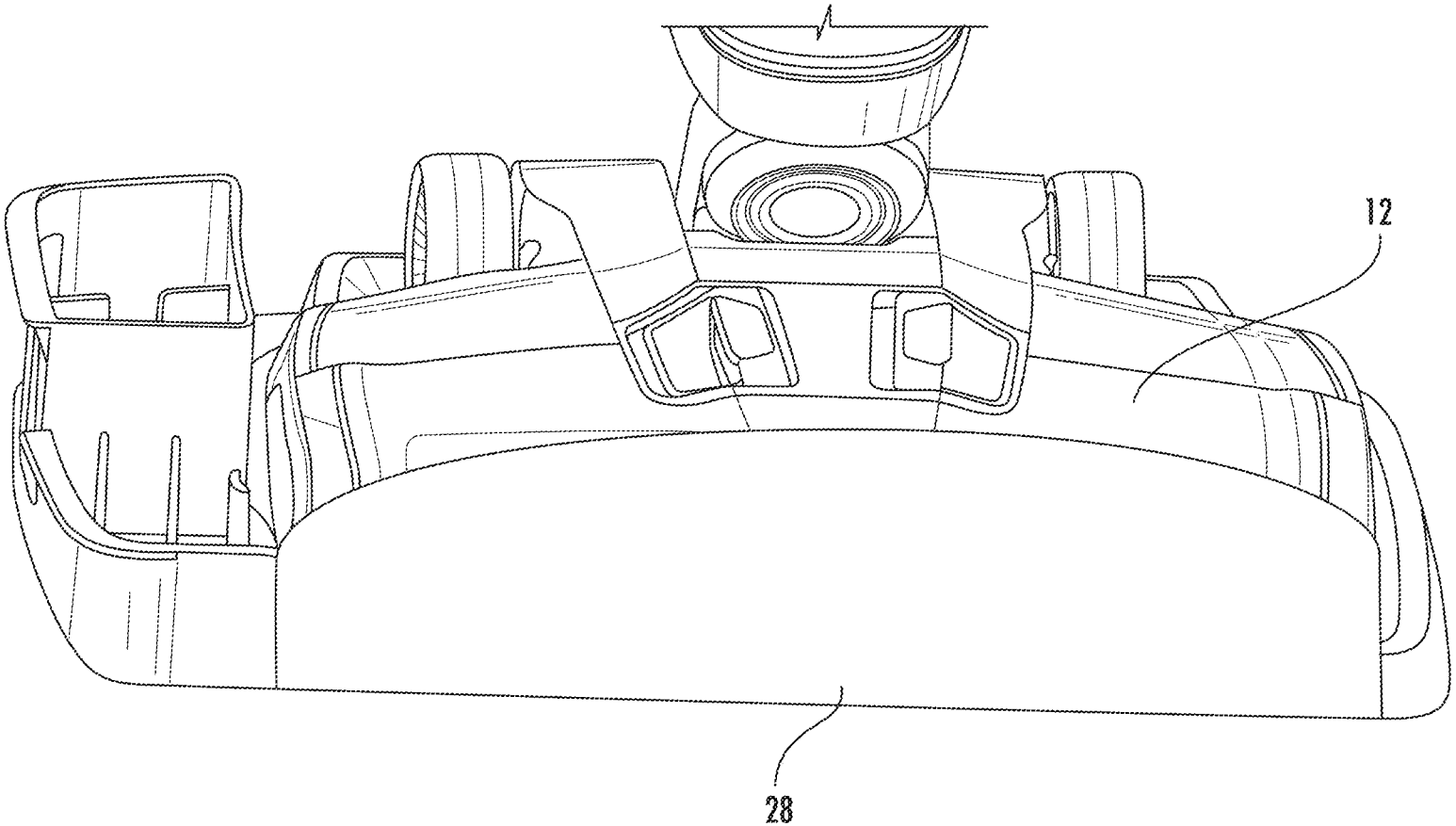
FIG. 4 is a front perspective view of the base of the floor cleaner and cleaning tray.

The base 12 of the floor cleaner 10 is movable over a surface to be cleaned. The base 12 includes the distribution nozzle 32 in fluid communication with the supply tank 16 controlled by a pump 34. When the floor cleaner 10 is in the inclined use position in operation, the distribution nozzle 32 dispenses cleaning fluid toward the surface to be cleaned and the first switch 42 enables operation of the brushroll 26 for agitating the surface to be cleaned. When the floor cleaner 10 is in the cleaning tray 28 in the upright storage position, the distribution nozzle 32 dispenses cleaning fluid to the reservoir 54 of the cleaning tray 28 and the second switch 44 enables the brushroll 26 to operate for cleaning the brushroll 26 in the reservoir 54 in the cleaning mode. In the embodiment shown in FIG. 3, the cleaning tray 28 is configured to at least partially surround the distribution nozzle 32, such that cleaning fluid is distributed along arrow A, contacts the cleaning tray 28, and is directed downwardly along the surface of the cleaning tray 28, and into the reservoir 54. In another embodiment shown in FIG. 3*a*, the fluid distributor 56, shown schematically, includes an auxiliary fluid outlet 36 in communication with the supply tank 16 controlled by a valve 38 activated by the second switch 44. The auxiliary fluid outlet 36 may be configured to provide a flow rate greater than provided by the pump 34 and distribution nozzle 32. The auxiliary fluid outlet 36 is positioned above the reservoir 54 when the base 12 is positioned on the cleaning tray 28 such that cleaning fluid from the supply tank 16 flows along arrow B into the reservoir when the valve 38 is actuated by the second switch 44.

In one embodiment, the floor cleaner 10 includes a pressure sensor that senses a suction pressure. The pressure sensor is in communication with the controller. The pressure sensor and the controller are configured such that the floor cleaner 10 will not distribute solution if the suction generated by the suction motor 20 is insufficient. For example, if the pressure sensor determines that the suction pressure is above a predetermined pressure value, that is, the suction pressure is not low enough, the floor cleaner 10 will not distribute solution. The may occur if the recover tank 18 is full. In this embodiment, the floor cleaner will not enter the cleaning mode when the recovery tank 18 is full.

In one embodiment, the cleaning mode is manual, with the user initiating the mode by manually depressing a pushbutton 50 and a trigger 52 located on the handle of the floor cleaner 10 when the floor cleaner 10 is in the cleaning tray 28. The pushbutton 50, which is an on/off button in one example, activates the suction motor 20 and brushroll motor 46, while the trigger 52 distributes cleaning fluid to the cleaning tray 28. The cleaning fluid and debris are removed from the brushroll 26 and collect in the cleaning tray 28, where they are sucked through the suction inlet 30 and through the recovery path to the recovery tank 18.

In one embodiment, the cleaning mode is automated. The automated cleaning mode is controlled by the control circuit 40, which may include the controller. The controller is operatively connected to the supply tank 16, the fluid distributor 56, the suction motor 20, and the brushroll motor 46. The controller is further operably coupled with a user interface for receiving inputs from the user. In response to user activation, the controller is configured to activate the cleaning mode when the floor cleaner 10 is in the cleaning tray 28.

The cleaning mode consists of a distribution phase and an extraction phase. During the distribution phase, cleaning fluid is distributed from the supply tank 16 through the fluid distributor 56, and into the reservoir 54 of the cleaning tray 28. During the extraction phase the brushroll motor 46 is activated, allowing the brushroll 26 to rotate in the cleaning fluid in the cleaning tray 28 to remove dirt and debris. The suction motor 20 is also activated to extract the cleaning fluid, dirt, and debris through the suction inlet 30. The distribution phase and extraction phase may run simultaneously, or may be staggered or sequential. In one embodiment, the cleaning mode includes a distribution phase, an agitation phase, and an extraction phase. In this embodiment, cleaning fluid is distributed from the supply tank 16 into the reservoir 54 in the distribution phase. In the agitation phase, the brushroll motor 46 is activated, rotating the brushroll 26 in the cleaning fluid in the cleaning tray 28 to remove dirt and debris while the suction motor 20 is not activated. Then, the suction motor is activated in the extraction phase. The distribution phase, agitation phase, and extraction phase may run simultaneously, or may be staggered or sequential. The cleaning mode can optionally repeat the distribution phase and/or extraction phase and/or agitation phase if present one or more times. The length of each phase and quantity of cleaning fluid dispensed in the cleaning mode may be time-dependent or may continue until the recovery tank 18 is full or the supply tank 16 is empty.

In one embodiment of the automated cleaning mode, the user activation is the user actuating a pushbutton 50 on the floor cleaner 10. In another embodiment, the user activation is placing the floor cleaner 10 into the cleaning tray 28. In yet another embodiment, the user activation is an IR, Wi-Fi, Bluetooth, or other signal sent from a remote device by user interaction with the device, such as a remote control, cell phone, or computer.

In one embodiment, the control circuit 40 activates the brushroll motor 46 when the floor cleaner 10 is in the upright storage position in the cleaning tray 28 by a control circuit 40 being actuated by an actuator 48 in the cleaning tray 28 when the second switch senses the cleaning tray. In another embodiment, the control circuit 40 activates the brushroll motor 46 in the cleaning tray 28 by the user holding the floor cleaner 10 in the inclined use position and activating the cleaning mode when the first switch senses the inclined use position. In yet another embodiment illustrated in FIG. 1*a*, the cleaning tray 28 may include a support structure 24 configured to support the upright portion of the floor cleaner 14 in the inclined use position without the user holding the floor cleaner, allowing the brushroll motor 46 and the cleaning mode to be activated when the first switch senses the inclined use position.

The floor cleaner 10 may be cleaned in one embodiment by a method of cleaning a floor cleaner 10 using a cleaning tray 28 having an actuator 48 by receiving the floor cleaner 10 in the cleaning tray 28. The method includes sensing the presence of the cleaning tray 28 by a control circuit 40 in the floor cleaner 10 that is activated by the actuator 48. Stated another way, activating the control circuit 40 in the floor cleaner 10 by the cleaning tray actuator 48. The method further comprises activating a cleaning mode that distributes cleaning fluid from a supply tank 16 into the cleaning tray 28. The cleaning mode may further comprise activating the suction motor 20 to extract cleaning fluid from the cleaning tray 28. In a further embodiment, the brushroll 26 may be activated in the cleaning mode when the floor cleaner 10 is in the upright position in the cleaning tray 28. Alternatively, the control circuit 40 may be configured to prevent the activation of the cleaning mode if the cleaning tray 28 is not sensed or if the floor cleaner 10 is not in the upright position.

Various features and advantages of the invention are set forth in the following claims.

What is claimed is:

1. A combination of a cleaning tray and a floor cleaner comprising:

a cleaning tray forming a reservoir; and a floor cleaner, the floor cleaner including a base movable along a surface to be cleaned, at least a portion of the base received by the reservoir of the cleaning tray, an upright portion movable between an inclined use position and an upright storage position, a suction motor, a fluid distributer in fluid communication with a supply tank, a brushroll rotatably arranged in the base operatively connected to a brushroll motor;

a control circuit connected to the brushroll motor, the control circuit including, a first switch that is open when the upright portion is in the upright storage position and closed when the upright portion is in the inclined use position, and a second switch in parallel with the first switch, the second switch is opened when the portion of the base is removed from the cleaning tray and the second switch is closed when the portion of the base is in the cleaning tray.

2. The cleaning tray and the floor cleaner of claim 1, wherein the base includes the second switch, wherein the cleaning tray includes a mechanical actuator, and wherein the second switch is closed by the mechanical actuator when the base is in the cleaning tray.

3. The cleaning tray and the floor cleaner of claim 1, wherein the cleaning tray includes a magnet, and wherein the second switch is closed by the magnet when the base is in the cleaning tray.

4. The cleaning tray and the floor cleaner of claim 1, wherein the second switch includes a light activated switch actuated by the cleaning tray.

5. The cleaning tray and the floor cleaner of claim 1, wherein the second switch includes a proximity sensor actuated by the cleaning tray.

6. The cleaning tray and the floor cleaner of claim 1, further comprising a controller in the floor cleaner that is operatively connected to the fluid distributor, the controller being configured to distribute solution from the supply tank to the cleaning tray in response to a user activation when the floor cleaner is in the cleaning tray.

7. The cleaning tray and the floor cleaner of claim 6, wherein the controller in the floor cleaner is operatively connected to the suction motor, the controller being configured to operate the suction motor in response to the user activation.

8. The cleaning tray and the floor cleaner of claim 7, wherein the floor cleaner includes a pressure sensor configured to prevent distribution of solution if suction generated by the suction motor is above a predetermined pressure value.

9. A method of cleaning a floor cleaner having a supply tank, a recovery tank, and a fluid distributor using a cleaning tray having an actuator, the method comprising:

sensing the cleaning tray by a control circuit in the floor cleaner, the control circuit activated by the actuator;

activating a cleaning mode; and distributing cleaning fluid from the supply tank into the cleaning tray via the fluid distributor in the cleaning mode.

10. The method of claim 9, further comprising the control circuit sensing the floor cleaner in an upright storage position.

11. The method of claim 10, further comprising preventing activation of the cleaning mode if the upright position is not sensed.

12. The method of claim 9, wherein the step of activating a cleaning mode includes activating the cleaning mode in response to a user activation.

13. The method of claim 9, wherein the floor cleaner includes a suction motor, the method further comprising extracting the fluid from the cleaning tray into the recovery tank by activating the suction motor in the cleaning mode.

14. The method of claim 9, wherein the floor cleaner includes a brushroll, the method further comprising activating the brushroll in the cleaning mode.

15. The method of claim 9, further comprising preventing activation of the cleaning mode if the cleaning tray is not sensed.

16. A combination of a cleaning tray and a floor cleaner comprising:

a cleaning tray having an actuator;

a floor cleaner including a base movable along a surface to be cleaned, an upright portion movable between an inclined use position and an upright storage position, a brushroll rotatably arranged in the base, the brushroll driven by a brushroll motor, the floor cleaner including a control circuit that controls the brushroll, the control circuit operable in (1) a brushroll-enabled condition when the upright portion is in the inclined use position, (2) a brushroll-disabled condition when the upright portion is in the upright storage position and the floor cleaner is not in the cleaning tray, and (3) a brushroll-enabled condition when the floor cleaner is in the cleaning tray;

where the cleaning tray actuator activates the control circuit into the third condition, and the control circuit enables a cleaning mode in the third condition.

17. The cleaning tray and the floor cleaner of claim 16, where the control circuit activates the brushroll motor in the cleaning mode.

18. The cleaning tray and the floor cleaner of claim 16, further comprising a supply tank and a fluid distribution system, where the control circuit activates the fluid distribution system in the cleaning mode.

19. The cleaning tray and the floor cleaner of claim 16, further comprising a suction motor in fluid communication with a suction inlet in the base of the floor cleaner, where the control circuit activates the suction motor in the cleaning mode.

20. A combination of a cleaning tray and a floor cleaner comprising:

a cleaning tray; and a floor cleaner, the floor cleaner including a base movable along a surface to be cleaned, an upright portion movable between an inclined use position and an upright storage position, a suction motor, a fluid distributer in fluid communication with a supply tank, a brushroll rotatably arranged in the base operatively connected to a brushroll motor, the brushroll motor operable when the upright portion is in the upright storage position in the cleaning tray; and the cleaning tray forming a reservoir that receives at least a portion of the base of the floor cleaner, wherein the brushroll motor is inoperable when the upright portion is in the upright storage position outside of the cleaning tray.

21. The cleaning tray and the floor cleaner of claim 20, further comprising a control circuit connected to the brushroll motor, the control circuit operable in a brushroll-enabled condition when the floor cleaner is in the cleaning tray and a brushroll-disabled condition when the upright portion is in the upright storage position and the floor cleaner is not in the cleaning tray.

22. The cleaning tray and the floor cleaner of claim 21, where the cleaning tray further comprises an actuator operable to activate the control circuit into the brushroll-enabled condition when the floor cleaner is in the cleaning tray.

* * * * *